US006882300B2

(12) United States Patent
Nakamura et al.

(10) Patent No.: US 6,882,300 B2
(45) Date of Patent: Apr. 19, 2005

(54) GUIDE MARKER AND VISUAL GUIDE MARKER DEVICE

(75) Inventors: Fuminori Nakamura, Nagaokakyo (JP); Toru Tanizaki, Kyoto (JP); Yohei Ishikawa, Yokohama (JP); Taiyo Nishiyama, Otsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 45 days.

(21) Appl. No.: 10/395,145

(22) Filed: Mar. 25, 2003

(65) Prior Publication Data

US 2003/0214429 A1 Nov. 20, 2003

(30) Foreign Application Priority Data

Mar. 25, 2002 (JP) ..... 2002-082271
Mar. 25, 2002 (JP) ..... 2002-082272
Mar. 6, 2003 (JP) ..... 2003-059410

(51) Int. Cl.[7] ..... H01Q 15/00
(52) U.S. Cl. ..... 342/7; 342/5
(58) Field of Search ..... 342/4–10; 359/530, 359/546, 547

(56) References Cited

U.S. PATENT DOCUMENTS 3,365,790 A * 1/1968 Brauer ..... 29/600
3,721,983 A * 3/1973 Sherer ..... 342/10
4,149,304 A 4/1979 Brynjegard
4,176,355 A * 11/1979 Harris ..... 342/7
5,642,118 A * 6/1997 Grannemann ..... 342/4
6,218,978 B1 * 4/2001 Simpkin et al. ..... 342/5
6,225,940 B1 * 5/2001 Ohlsen ..... 342/5

FOREIGN PATENT DOCUMENTS

EP 1 083 625 A2 3/2001
JP 10-107540 4/1998

* cited by examiner

*Primary Examiner*—Bernarr E. Gregory
*Assistant Examiner*—Brian Andrea
(74) *Attorney, Agent, or Firm*—Keating & Bennett, LLP

(57) ABSTRACT

A guide marker includes a substrate and a radio-wave reflecting unit for reflecting radio waves at certain intensity in all directions in a virtual plane, including the incident direction of the radio waves, the radio-wave reflecting unit being provided in the surface of the substrate. The radio-wave reflecting unit includes a concave and convex portions provided in the substrate or radio-wave reflectors which resonate at the frequency of incident radio waves and which reflect the radio waves in the incident direction. The radio-wave reflectors are mounted on the substrate. A visual guide marker device includes one of a light-reflecting component having a reflection characteristic and a light-generating component which self-generates light, and a guide marker including a dielectric material.

19 Claims, 16 Drawing Sheets

GUIDE MARKER AND VISUAL GUIDE MARKER DEVICE

BACKGROUND OF THE INVENTION

1. Field of the Invention

The present invention relates to a guide marker in which the reflecting direction of incident radio waves is not specified, and to a visual guide marker device used for restricting the range of travel of vehicles and for guiding the vehicles.

2. Description of the Related Art

In order to ensure safe driving of vehicles, such as automobiles, visual guide marker devices are placed on the roadside and median strips. The visual guide marker devices indicate the shape of a road and the centerline so as to restrict the range where vehicles can travel, and guide the vehicles in a predetermined direction so that the vehicles do not travel outside the range. As such visual guide marker devices, delineators, pole cones, and snow poles are widely known.

For example, a delineator includes a frame attached at the top of a post which is fixed to a guard rail and a light reflector having a reflection characteristic mounted to the frame. Also, a light-generating visual guide marker device is known, which includes a light-generating component.

In this type of visual guide marker device, when light from a light source, such as a headlight, is incident upon the light reflector, the light is reflected by the light reflector in the same direction as the incident direction so as to shine brightly. Accordingly, the reflected light is visually recognized by a driver such that visual guiding is performed. Under low visibility, for example, at night, in thick fog, or during snowfall, visual guiding is performed by light-generating components which generate light by themselves.

On the other hand, in recent years, Intelligent Transport Systems (ITS) has been used to improve convenience and safety in traffic so as to realize high efficiency. As part of the ITS, Advanced Cruise-assist Highway Systems (AHS) have been considered. In AHS, radio waves having a wavelength of a few millimeters or more are radiated from a radio-wave radar mounted on a vehicle, and the radio waves are reflected at a guide marker serving as a radio-wave reflector which is provided on a road and are received by the radar, such that the range where the vehicle can travel is restricted and the existence of obstacles is detected so as to guide the vehicle in an appropriate direction.

The AHS performs visual guiding for a driver. In addition, the AHS restricts the range where the vehicle can travel based on information generated by transmission/reception of radio waves using a vehicle-mounted radar so as to guide the vehicle, and attracts attention of the driver when the vehicle approaches a dangerous location.

A guide marker including a radio-wave reflector is disclosed in Japanese Unexamined Patent Application Publication No. 10-107540. In this guide marker, radiating elements which resonate at the frequency of incident radio waves from a specific direction and which reflect the radio waves in the incident direction are placed on the surface of the guide marker. That is, the guide marker is configured with the assumption that radio waves will enter the guide marker from a specific direction and that the radio waves are reflected in the specific incident direction. Specifically, a plurality of radiating elements including a conductive material, such as metallic foil, are printed in an array on an insulator, such as paint.

Also, Japanese Unexamined Patent Application Publication No. 10-107540 discloses radio-wave reflectors including radiating elements having concave and convex portions functioning as a square-cone corner reflector. In the radio-wave reflectors, a plurality of concave and convex portions are arranged in parallel on the surface of an insulator, the concave and convex portions are not smooth with respect to the wavelength of radio waves. In this guide marker, radio waves entering from a specific direction are reflected in the incident direction.

In order to establish general AHS as a system for detecting obstacles by using vehicle-mounted radars, various obstacles on a road or at the roadside must be reliably detected. That is, in order to realize this type of AHS, various signs and objects, such as direction signs, sound barriers, guard rails, and curbs, must be reliably detected as obstacles.

However, if an obstacle does not reflect radio waves, the obstacle cannot be detected by a radio-wave radar, and thus the existence thereof cannot be detected. Accordingly, in order to establish general AHS, signs and objects on a road or at the roadside must reflect radio waves.

In addition, since the positions and sizes of the objects are different from each other, it is insufficient that radio waves coming from a specific direction are reflected, and radio waves from various unspecified directions must be reflected. Despite such a requirement, the above-described guide marker only reflects radio waves from a specific direction in the same specific direction.

That is, this guide marker does not reflect radio waves from various directions in all directions in a virtual plane including the incident direction. Therefore, even when the known guide marker is attached to objects on a road or at the roadside, those objects cannot be detected using a radio-wave radar.

Under this circumstance, a known corner reflector, for example, a metallic triangular-cone-shape corner reflector is attached to the objects so as to define a guide marker. With this configuration, the corner reflector is more preferable than a metallic flat plate, which reflects radio waves coming straight from the front in that same direction, because the corner reflector can also reflect radio waves coming from a direction other than the front direction.

However, the corner reflector cannot reflect radio waves coming from a direction which is about 30° or more from the front direction. On the other hand, in the AHS, in which obstacles must be detected by a vehicle-mounted radar, a guide marker for reflecting radio waves coming from various directions, including a direction which is substantially orthogonal to the front direction, at a certain intensity is required. Clearly, the known corner reflector cannot satisfy this requirement.

Furthermore, as described above, known visual guide marker devices only perform visual guiding of a vehicle by indicating light which has been reflected at a light reflector to a driver. Under present circumstances, this visual guide marker device cannot restrict a range where vehicles can travel based on transmission/reception of radio waves by a vehicle-mounted radar and cannot notify a driver of the existence of a dangerous location.

Accordingly, even when visual guide marker devices including light reflectors having a reflection characteristic are installed on roads, if it is difficult for a driver to visually recognize reflected light due to the driver's carelessness or bad weather, dangerous accidents, for example, a vehicle running off the road and crashing into an obstacle, cannot be prevented. In particular, during snowfall, snow adheres to the visual guide marker devices so that reflected light and generated light are blocked. As a result, effects of visual guiding are significantly decreased.

SUMMARY OF THE INVENTION

To overcome the problems described above, preferred embodiments of the present invention provide a guide marker for use in AHS, in which an obstacle is detected by a vehicle-mounted radar, that is, a guide marker in which a reflecting direction of incoming radio waves is not limited to a specific direction, and a visual guide marker device for performing guiding reflection of radio waves radiated from a vehicle-mounted radar as well as visual guiding for a driver.

According to a preferred embodiment of the present invention, a guide marker includes a radio-wave reflecting unit for reflecting radio waves in an incident direction of the radio waves, the radio-wave reflecting unit being provided on the surface of a substrate. The radio-wave reflecting unit reflects the radio waves in at least two incident directions.

Preferably, the radio-wave reflecting unit includes a concave portion and a convex portion integrally provided in the substrate. Each of the concave and convex portions are preferably substantially hemispherical. Alternatively, each of the concave and convex portions may extend almost linearly. The radio-wave reflecting unit and the substrate are preferably made of metal or ceramic.

With this arrangement, incident radio waves are reflected at certain intensity in all directions in a virtual plane, including the incident directions. Therefore, even when radio waves come from various unspecified directions, that is, even when the incident direction of the radio waves is changed, the reflecting direction of the radio waves is not specified.

The radio-wave reflecting unit preferably includes radio-wave reflectors which resonate at the frequency of incident radio waves and which reflect the radio waves in the incident direction, and the radio-wave reflectors may be mounted on the substrate.

A plurality of the radio-wave reflectors are preferably aligned in rows, and the pitches of the radio-wave reflectors in each row are preferably different from each other.

A plurality of the radio-wave reflectors may be aligned in rows, and the pitch d of the radio-wave reflectors in each row is defined by an expression: $d=\lambda \cdot n/2$, where $\lambda$ is the wavelength of the incident radio waves and n is an integer. The radio-wave reflectors are preferably made of metal or ceramic.

Accordingly, incident radio waves are reflected at certain intensity in all directions in a virtual plane, including the incident directions, by the radio-wave reflectors functioning as the radio-wave reflecting unit mounted on the substrate. Thus, even when radio waves come from various unspecified directions, the reflecting direction is not specified, and the radio waves are reliably reflected.

Preferably, the relative permittivity or of the ceramic is equal to or greater than about 5. With this arrangement, high reflection efficiency is obtained.

The ceramic may be recycled industrial waste generated from electronic components. In this way, industrial waste is effectively recycled.

According to another preferred embodiment of the present invention, a visual guide marker device includes one of a light-reflecting component having a reflection characteristic and a light-generating component which self-generates light, and a guide marker including a dielectric material.

With this configuration, even when light which has been reflected at the light-reflecting component cannot be sufficiently recognized due to driver's carelessness or bad weather, radio waves transmitted from a vehicle-mounted radar are reflected at the guide marker. Accordingly, operation of the vehicle is greatly improved while ensuring safety.

Preferably, the relative permittivity of the guide marker is greater than that of the light-reflecting component or the light-generating component. With this arrangement, a radio-wave reflection intensity that is sufficient for transmission/reception with the vehicle-mounted radar is ensured.

Also, a thickness t of the guide marker is defined by an expression: $t=\lambda \cdot n/(2 \cdot \sqrt{\in r})$, where $\lambda$ is the wavelength of the incident radio waves, n is an integer, and $\in r$ is relative permittivity. Accordingly, the radio waves are efficiently reflected.

The light-reflecting components are preferably provided at a front stage with respect to the incident direction of radio waves and the guide marker are preferably provided at a back stage. With this arrangement, even when the guide marker is thin, it is protected by the light-reflecting component and thus is not damaged. Also, since the light-reflecting component and the guide marker are laminated to one another, the visual guide marker device is advantageously miniaturized.

Alternatively, the guide marker may be provided at a front stage with respect to the incident direction of radio waves and the light-reflecting component may be provided at a back stage. With this arrangement, miniaturization is also achieved. In addition, radio waves are reflected more efficiently than in the case where the guide marker is provided on the back side of the light-reflecting component.

Further, the guide marker is preferably made of light-transmissive ceramic. Accordingly, the reflection characteristic of the light-reflecting component is not deteriorated even when the guide marker is provided over the light-reflecting component. Therefore, a visual guide marker device which has an appropriate radio-wave reflection characteristic and light reflection characteristic is obtained.

The guide marker reflects radio waves in substantially the same direction as the incident direction of the radio waves. Accordingly, the radio waves radiated from the vehicle-mounted radar are not diffused in many directions so as to be weakened. As a result, the radio waves reflected at the guide marker are reliably received by the vehicle-mounted radar.

Other features, elements, characteristics and advantages of the present invention will become more apparent from the following detailed description of preferred embodiments thereof with reference to the attached drawings.

DESCRIPTION OF THE PREFERRED EMBODIMENTS

Hereinafter, preferred embodiments of the present invention will be described with reference to the drawings.

First Preferred Embodiment

Figure 1:
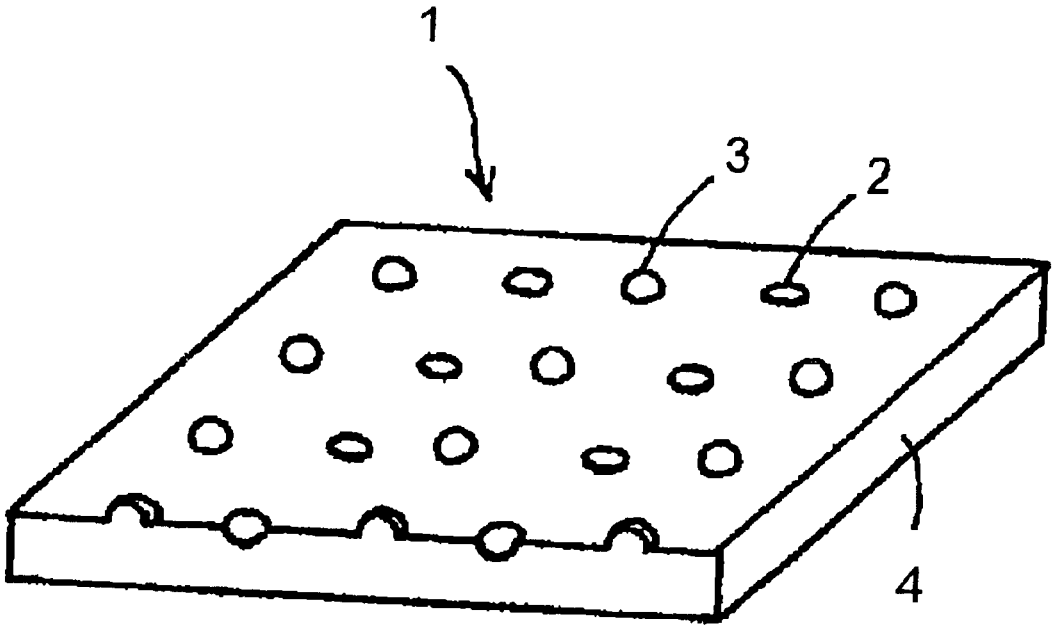
FIG. 1 is a perspective view showing an example of a guide marker, which is a radio-wave reflector, according to a first preferred embodiment of the present invention.
Figure 2:
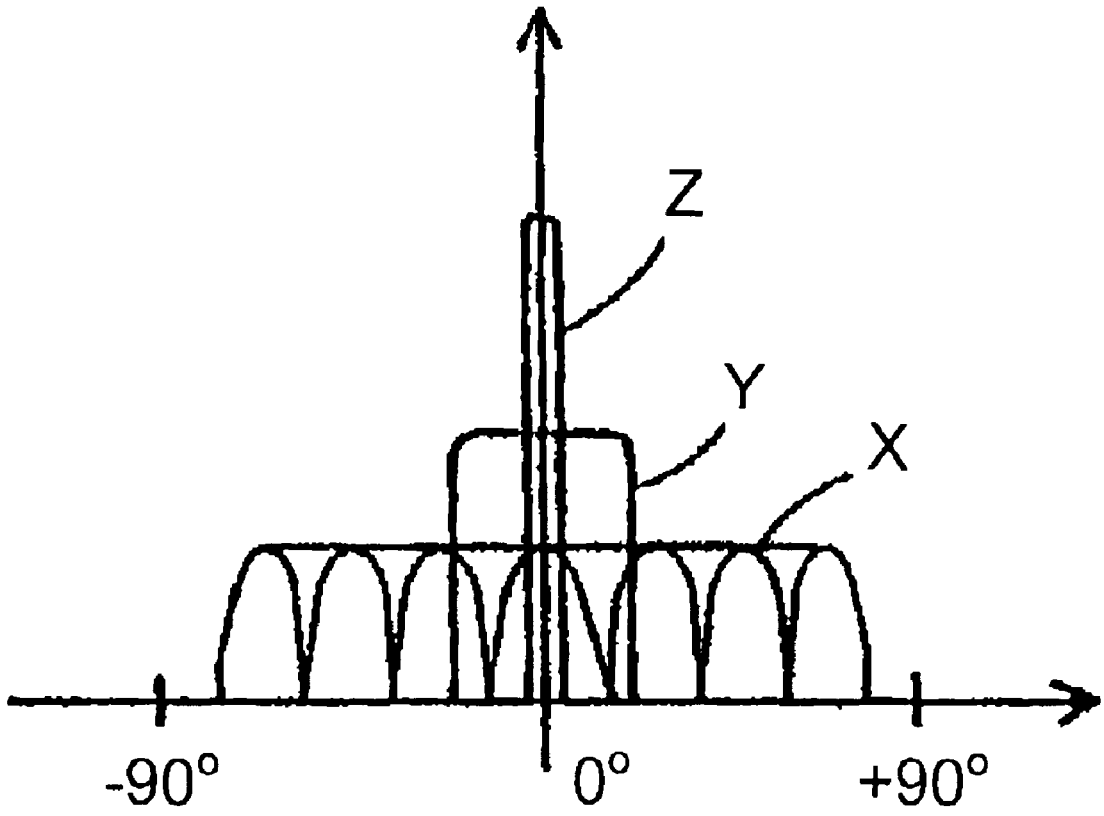
FIG. 2 illustrates the reflection characteristic of the guide marker according to the first preferred embodiment of the present invention.
Figure 3:
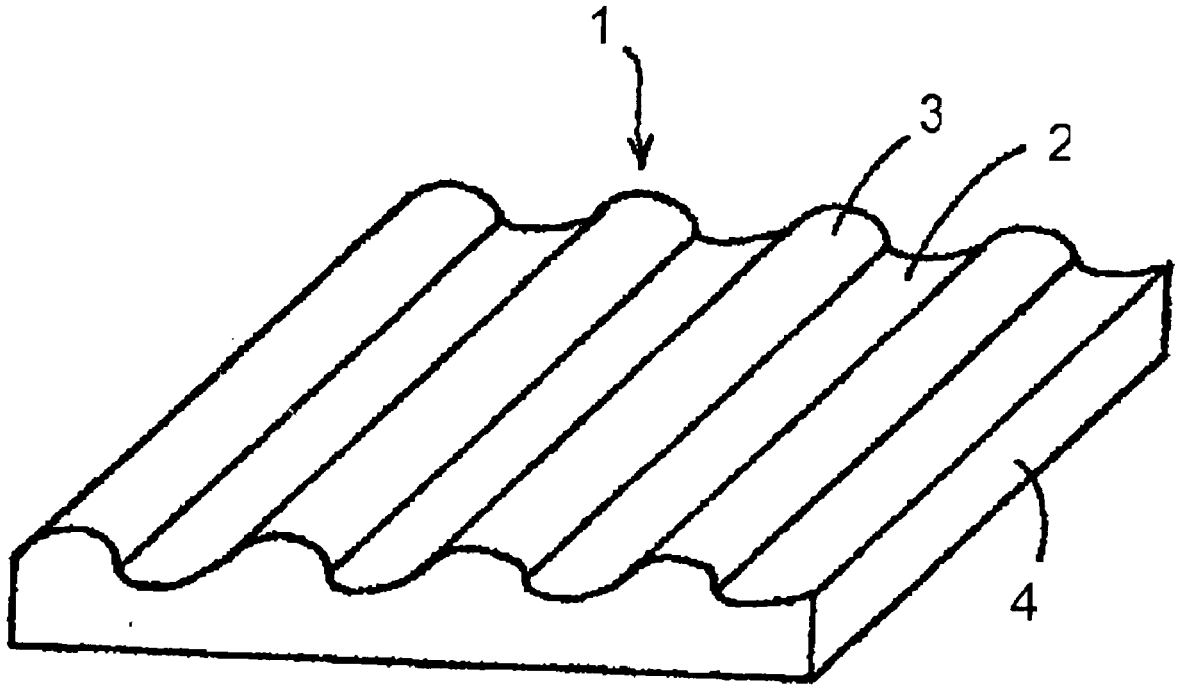
FIG. 3 is a perspective view showing another example of the guide marker according to the first preferred embodiment of the present invention.
Figure 4:
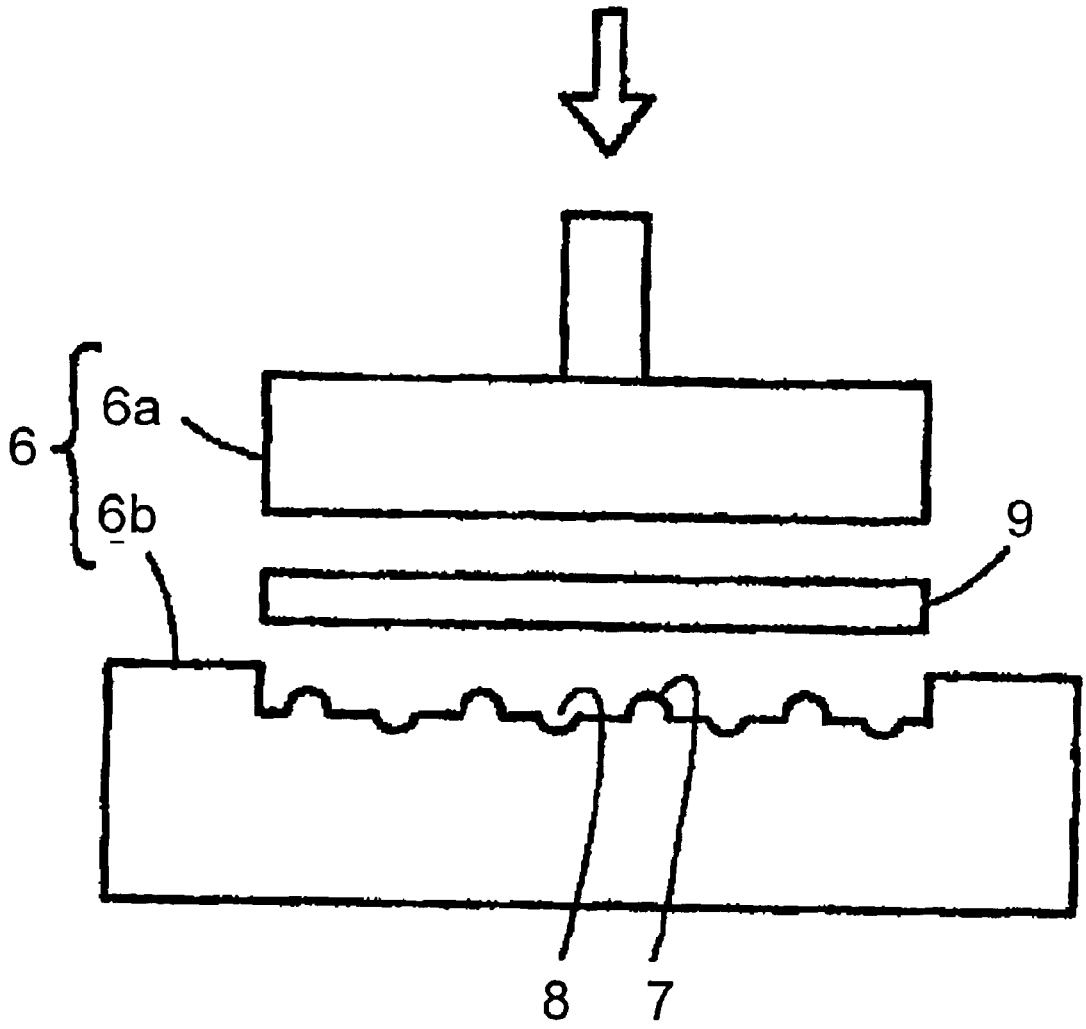
FIG. 4 illustrates a method for manufacturing the guide marker according to the first preferred embodiment of the present invention.

FIG. 1 is a perspective view showing an example of a guide marker, which is a radio-wave reflector, according to a first preferred embodiment. FIG. 2 illustrates the reflection characteristic thereof, that is, the reflection characteristic at a plane (virtual plane) to which radio waves enter vertically. FIG. 3 is a perspective view showing another example of the guide marker; and FIG. 4 illustrates the manufacturing method thereof. In FIGS. 1 and 3, reference numeral 1 denotes a guide marker.

As shown in FIG. 1, the guide marker 1 includes a substrate 4 and a plurality of concave portions 2 and convex portions 3 which are provided in the surface of the substrate 4 and which reflect radio waves. Herein, the entire guide marker 1 is preferably made of metal or ceramic, and each of the concave and convex portions 2 and 3 is substantially hemispherical.

That is, in this guide marker 1, each of the concave and convex portions 2 and 3 provided in the surface of the substrate 4 intensely reflects a radio wave entering at a different angle back along the incident direction. Thus, the entire surface of the substrate 4 provided with the concave and convex portions 2 and 3 intensely reflects radio waves in two or more incident directions. Accordingly, if radio waves from various unspecified directions enter the substrate 4 or if the incident direction of the radio waves changes, the reflecting direction is not in a single specific direction, but rather, the incident radio waves are intensely reflected in a plurality of directions. Thus, the radio waves can be reflected in any direction.

When the guide marker 1 according to the first preferred embodiment is preferably attached to various signs and objects on a road or at the roadside, such as direction signs, sound barriers, guard rails, and curbs, the locations and sizes thereof being different from each other, and when the incident direction of radio waves having a wavelength of a few millimeters or more, which are transmitted from a radio-wave radar provided in an automobile, changes, the incident radio waves are reliably reflected at the guide marker 1. Accordingly, the guide marker 1 is suitable for use in general Advanced cruise-assist Highway Systems (AHS), in which an obstacle on a road or at the roadside can be detected by a vehicle-mounted radar.

By comparing and considering the reflection characteristic of the guide marker 1 and the reflection characteristics of a metallic plate and a corner reflector, a result shown in FIG. 2 is obtained. In FIG. 2, X denotes an envelope created by coupling the peaks of the reflection characteristic of the guide marker 1, Y denotes the reflection characteristic of the corner reflector, and Z denotes the reflection characteristic of the metallic plate. As shown in FIG. 2, the guide marker 1 has improved reflection characteristics as compared to that of the metallic plate and the corner reflector. That is, the reflection characteristic of the guide marker 1 is substantially the same in a wide range of incident directions of radio waves. In FIG. 2, the horizontal axis indicates an incident (reflection) angle and the vertical axis indicates the intensity of reflection.

In the guide marker 1 shown in FIG. 1, the concave and convex portions 2 and 3 are preferably arranged uniformly and substantially parallel in the surface of the substrate 4. Alternatively, the concave and convex portions 2 and 3 may be randomly arranged in the surface of the substrate 4 at irregular pitches. Also, each of the concave and convex portions 2 and 3 need not be hemispherical, and may be circular-column-shaped, polygonal-prism-shaped, or polygonal-cone-shaped, or other suitable shape. Further, the concave and convex portions 2 and 3 may have a different shape from each other.

Further, as show in FIG. 3, a plurality of the concave and convex portions 2 and 3 are preferably arranged in the surface of the substrate 4 so as to extend linearly and to define a substantially semicircle cross-section in the guide marker 1. With this arrangement, the same radio-wave reflection characteristic as in the above-described case are ensured. In other words, the guide marker 1 should include the substrate 4 having a plurality of concave and convex portions 2 and 3, each reflecting a radio wave entering at an angle, so that the radio waves are intensely reflected in a plurality of incident directions.

When the guide marker 1 is made of ceramic, the relative permittivity $\in r$ of the ceramic is preferably about 5 or more, that is, $\in r \geqq 5$. By designing the guide marker 1 in this manner, high reflection efficiency is obtained. More preferably, the ceramic is preferably made of recycled industrial waste generated from electronic components. A factory for manufacturing the guide marker 1 of this preferred embodiment also produces electronic components such as capacitors. Therefore, the industrial waste is effectively recycled.

Now, a method for manufacturing the guide marker 1 will be described. In order to manufacture the guide marker 1 using a metallic material, a press forming method is preferably used and makes use of a stamping die 6 shown in FIG. 4. The stamping die 6 includes a drag 6*a* having a cavity provided with projections 7 and recesses 8 at the bottom thereof, which correspond to the concave and convex portions 2 and 3 of the guide marker 1, and a cope 6*b* which is pressed in the cavity. Then, a metallic plate 9 having a predetermined thickness is placed in the cavity of the drag 6*a* and is pressed with the cope 6*b*, so that the guide marker 1 including the substrate 4 provided with the concave and convex portions 2 and 3 is formed.

On the other hand, in order to manufacture the guide marker 1 with a ceramic material, a ceramic powder is put into the cavity of the drag 6*a* and the ceramic powder is pressed with the cope 6*b* under a predetermined temperature so as to mold the ceramic material. The manufacturing method of the guide marker 1 is not limited to press forming. Alternatively, although not shown, die-casting or insert injection molding may be used so as to form the guide marker 1 including the substrate 4 provided with the concave and convex portions 2 and 3.

Second Preferred Embodiment

Figure 5:
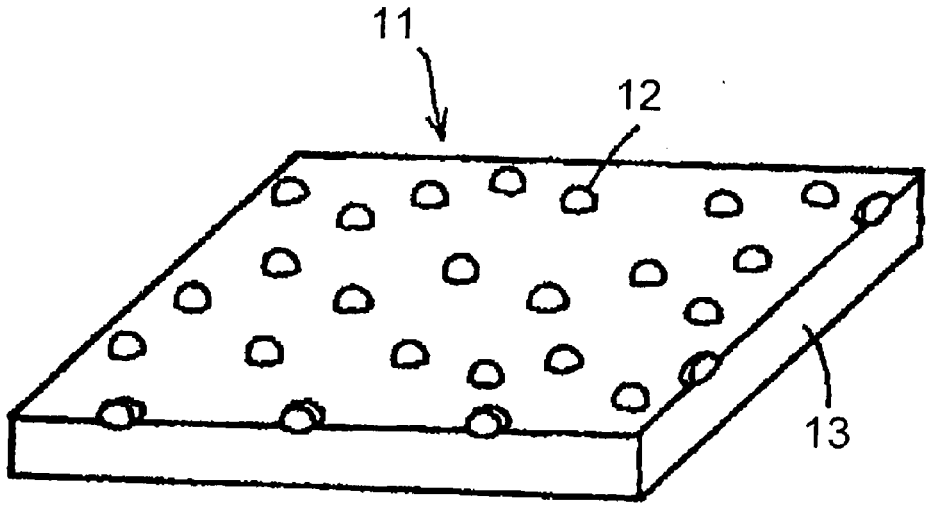
FIG. 5 is a perspective view showing an example of a guide marker according to a second preferred embodiment of the present invention.
Figure 6:
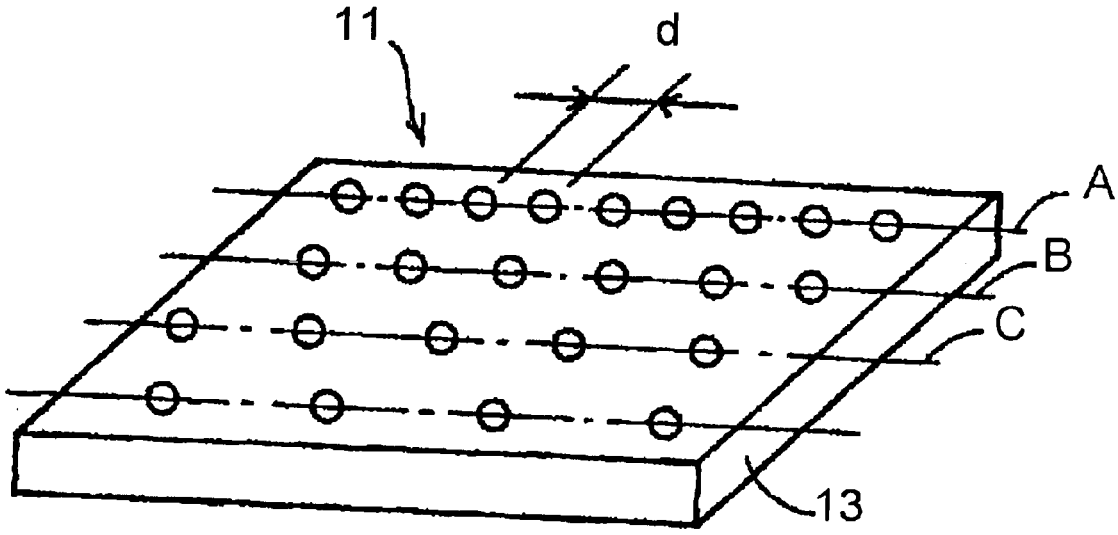
FIG. 6 is a perspective view showing another example of the guide marker according to the second preferred embodiment of the present invention.

FIG. 5 is a perspective view showing an example of a guide marker according to a second preferred embodiment and FIG. 6 is a perspective view showing another example of the guide marker. In FIGS. 5 and 6, reference numeral 11 denotes a guide marker.

As shown in FIG. 5, the guide marker 11 includes a substrate 13 including a resin or paint and a plurality of radio-wave reflectors 12 which reflect radio waves. Each of the radio-wave reflectors 12 is preferably made of metal or ceramic grains, is substantially spherical, and resonates at the frequency of incident radio waves so as to reflect the radio waves in the incident direction. The radio-wave reflectors 12 made of metal or ceramic grains are exposed at the surface of the substrate 13, such that they are positioned at irregular pitches. Each of the radio-wave reflectors 12 need not be spherical, and may be circular-column-shaped, polygonal-prism-shaped, or polygonal-cone-shaped, or other suitable shape.

In this guide marker 11, each of the radio-wave reflectors 12 mounted on the substrate 13 has a characteristic of reflecting a radio wave to a different direction in each specific region, and thus, the entire surface of the substrate 13 provided with the radio-wave reflectors 12 has a wide-range reflection characteristic, as in the first preferred embodiment. Accordingly, if radio waves enter the substrate 13 from various unspecified directions, the reflection directions are not specified, and the incident radio waves are reflected at a sufficient intensity in any direction in a virtual plane, including the incident directions.

Accordingly, when the guide marker 11 is attached to signs and objects on a road or at the roadside, and when the incident directions of radio waves transmitted from a radio-wave radar mounted on an automobile change, the incident radio waves are reliably reflected at the guide marker 11. Thus, the guide marker 11 is suitable for use in general AHS, in which an obstacle on a road or at the roadside must be detected by a vehicle-mounted radar. In the guide marker 11 shown in FIG. 5, the radio-wave reflectors 12 are randomly arranged on the surface of the substrate 13. However, the radio-wave reflectors 12 may be uniformly arranged.

Referring to FIG. 6, in the guide marker 11, the plurality of radio-wave reflectors 12 may be aligned in a plurality of rows A, B, C, . . . . The pitch of the radio-wave reflectors 12 may be different in each row. In this case, pitch d of the radio-wave reflectors 12 in each of the rows A, B, C, . . . , is preferably defined by the expression $d=\lambda \cdot n/2$, where $\lambda$ is the wavelength of incident radio wave and n is an integer.

With this arrangement, in row A, where pitch dl of the radio-wave reflectors 12 is defined by $d1=\lambda \cdot 1/2$, incident radio waves are reflected at a reflection angle $\theta 1$, and in row B, where pitch d2 of the radio-wave reflectors 12 is defined by $d2=\lambda \cdot 2/2$, incident radio waves are reflected at a reflection angle $\theta 2$ . Likewise, radio waves are reflected at a reflection angle $\theta 3$ in row C. Therefore, radio waves from various unspecified directions are reflected in any direction in a virtual plane, including the incident directions, in the guide marker 11.

With this arrangement, the operation in which the reflecting direction of radio waves is not specified is easily ensured. When the radio-wave reflectors 12 include ceramic, the relative permittivity of the ceramic is preferably about 5 or more, that is, $\in r \geqq 5$, so that high reflection efficiency is obtained. Of course, the ceramic for the radio-wave reflectors 12 may be made from recycled industrial waste generated from electronic components.

Further, in order to manufacture the radio-wave reflectors 12 according to the second preferred embodiment, press forming, die casting, or insert injection molding may be used. The radio-wave reflectors 12 manufactured by such methods are mounted on the substrate 13 including a resin or paint. Then, the guide marker 11 formed in this way is attached to signs and objects on a road or at the roadside, and reflects radio waves transmitted from a radio-wave radar mounted on an automobile in general AHS.

Third Preferred Embodiment

Figure 7:
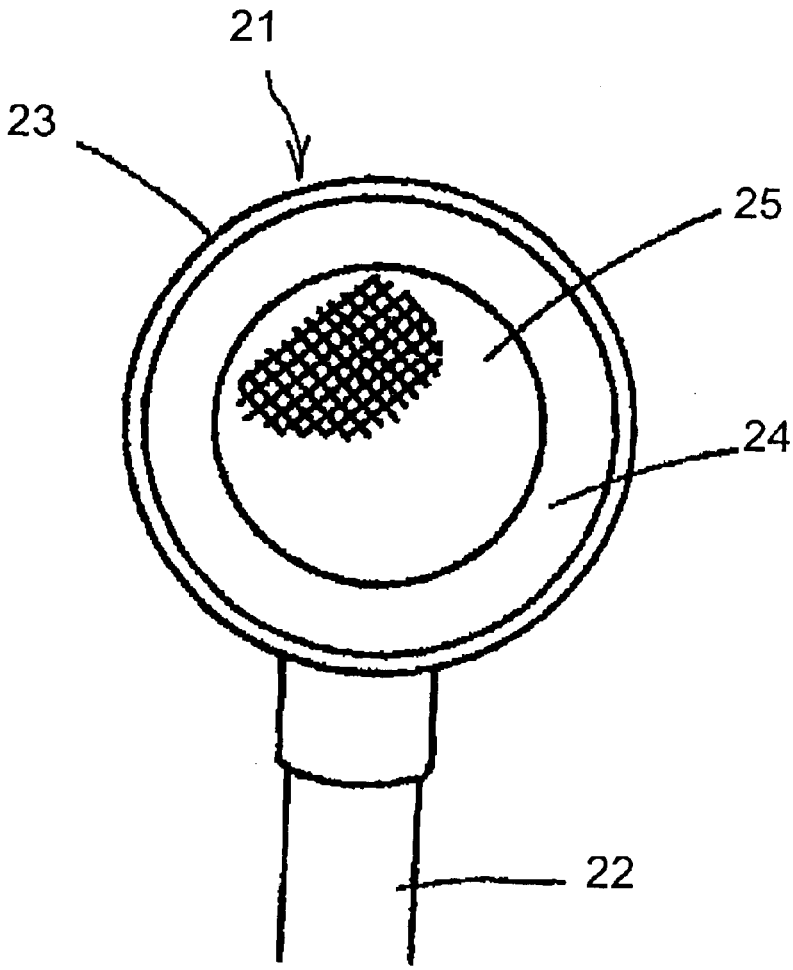
FIG. 7 is a front view showing the critical portion of a visual guide marker device according to a third preferred embodiment of the present invention.
Figure 8:
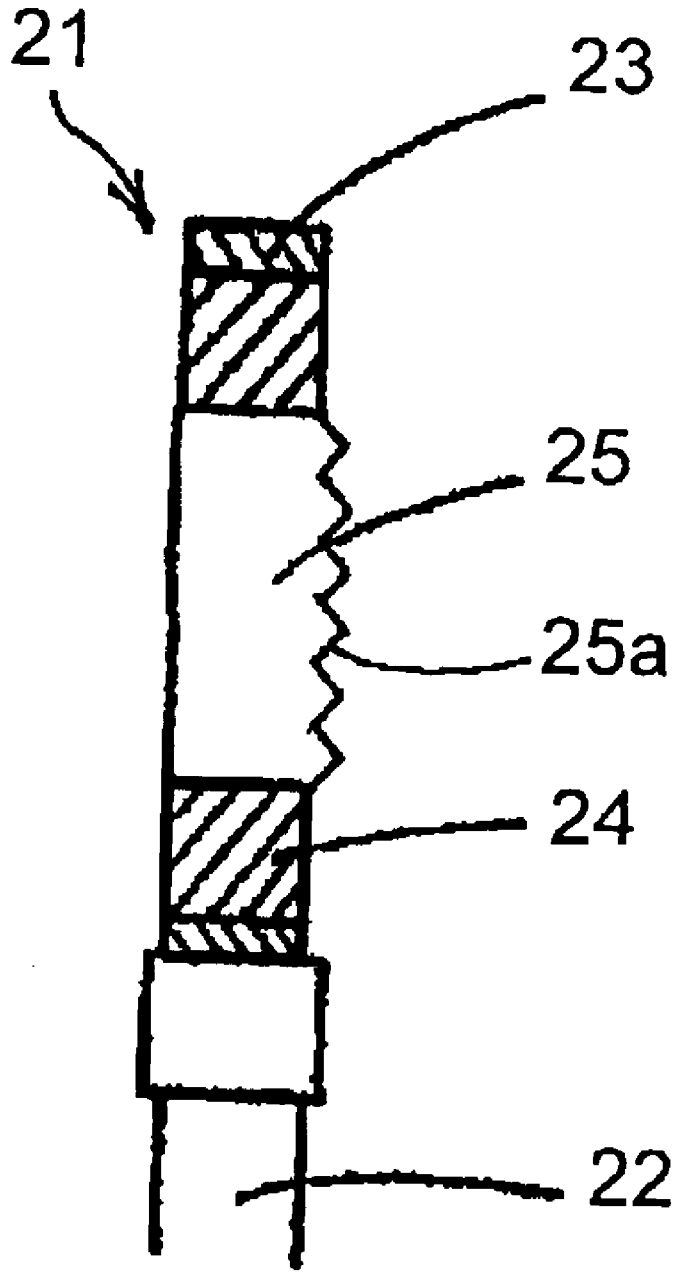
FIG. 8 is a longitudinal sectional view showing the critical portion of the visual guide marker device according to the third preferred embodiment of the present invention.
Figure 9:
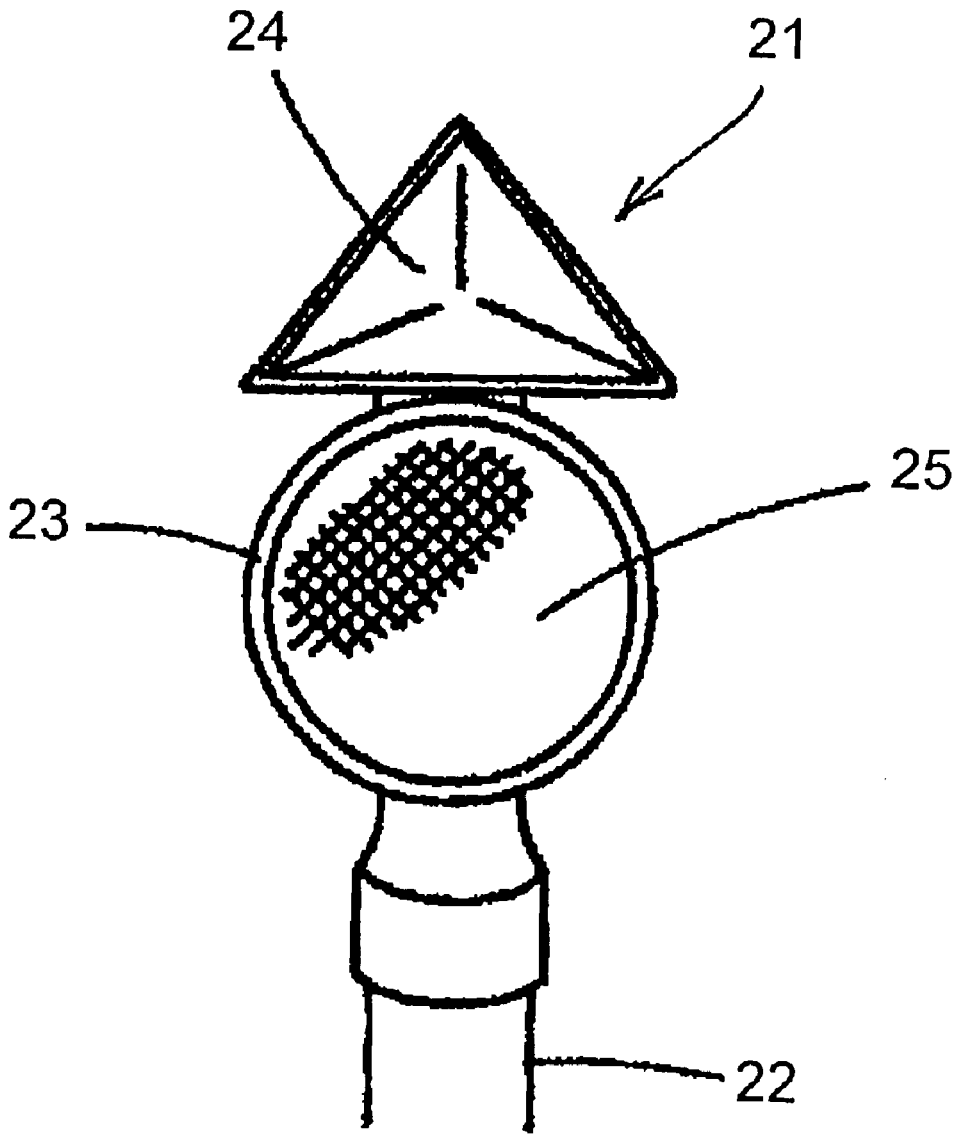
FIG. 9 is a front view showing a modification of the visual guide marker device according to the third preferred embodiment of the present invention.

FIG. 7 is a front view showing the critical portion of a visual guide marker device according to a third preferred embodiment, and FIG. 8 is a longitudinal sectional view thereof. Also, FIG. 9 is a front view showing a modification of the visual guide marker device. In these figures, reference numeral 21 denotes a visual guide marker device.

The visual guide marker device 21 is used as a delineator and includes a post 22 such as a guard rail, a circular frame 23 attached to the top of the post 22, a circular guide marker 24 provided in the frame 23, and a disk-shaped light reflector 25 which is concentrically arranged in the guide marker 24. That is, in the visual guide marker device 21, the guide marker 24 and the light reflector 25 are independent from each other.

The light reflector 25 includes a translucent synthetic resin, such as polycarbonate containing fluorescent dye. As shown in FIG. 8, a prism surface 25*a*, having a triangular-pyramid-shape or a square-pyramid-shape, is provided on the surface opposite to the surface to which light enters of the light reflector 25. With this configuration, light entering the light reflector 25 is reflected in substantially the same direction as the incident direction by the prism surface 25*a*.

Also, a substantially circular metallic plate is preferably used as the guide marker 24. However, the guide marker 24 may be a guide marker according to the first or second preferred embodiment.

When direct sunlight, diffused sunlight, or light from the headlight of a vehicle is radiated to the visual guide marker device 21, the light enters the light reflector 25. Then, the incident light becomes fluorescent light directly or by the fluorescent dye contained in the translucent synthetic resin, and is reflected in substantially the same direction as the incident direction at the prism surface 25*a* of the light reflector 25, so that the light is visually recognized by the driver.

On the other hand, radio waves transmitted from the vehicle-mounted radar are reflected at the guide marker 24 and are then received by the radar. Therefore, when the light which is reflected at the light reflector 25 is not sufficiently recognized, the range of travel of a vehicle is still restricted so as to guide the vehicle in a predetermined direction, or attention of the driver is attracted when the vehicle approaches a dangerous place. In particular, during snowfall, snow is adhered to the visual guide marker device 21, and thus, visual guiding by the light reflector 25 is difficult to perform. However, the guide markers 24 are detected by the vehicle-mounted radar so that the vehicle is guided in a safe direction.

The visual guide marker device 21 according to the third preferred embodiment is formed by attaching the guide marker 24 to an existing light reflector 25, and thus, is easily achieved by reserving space for the guide marker 24. Further, in the visual guide marker device 21 shown in FIGS. 7 and 8, the light reflector 25 is arranged inside the guide marker 24. However, as shown in FIG. 9, the guide marker 24 may be attached above the circular frame 23 holding the light reflector 25.

Fourth Preferred Embodiment

Figure 10:
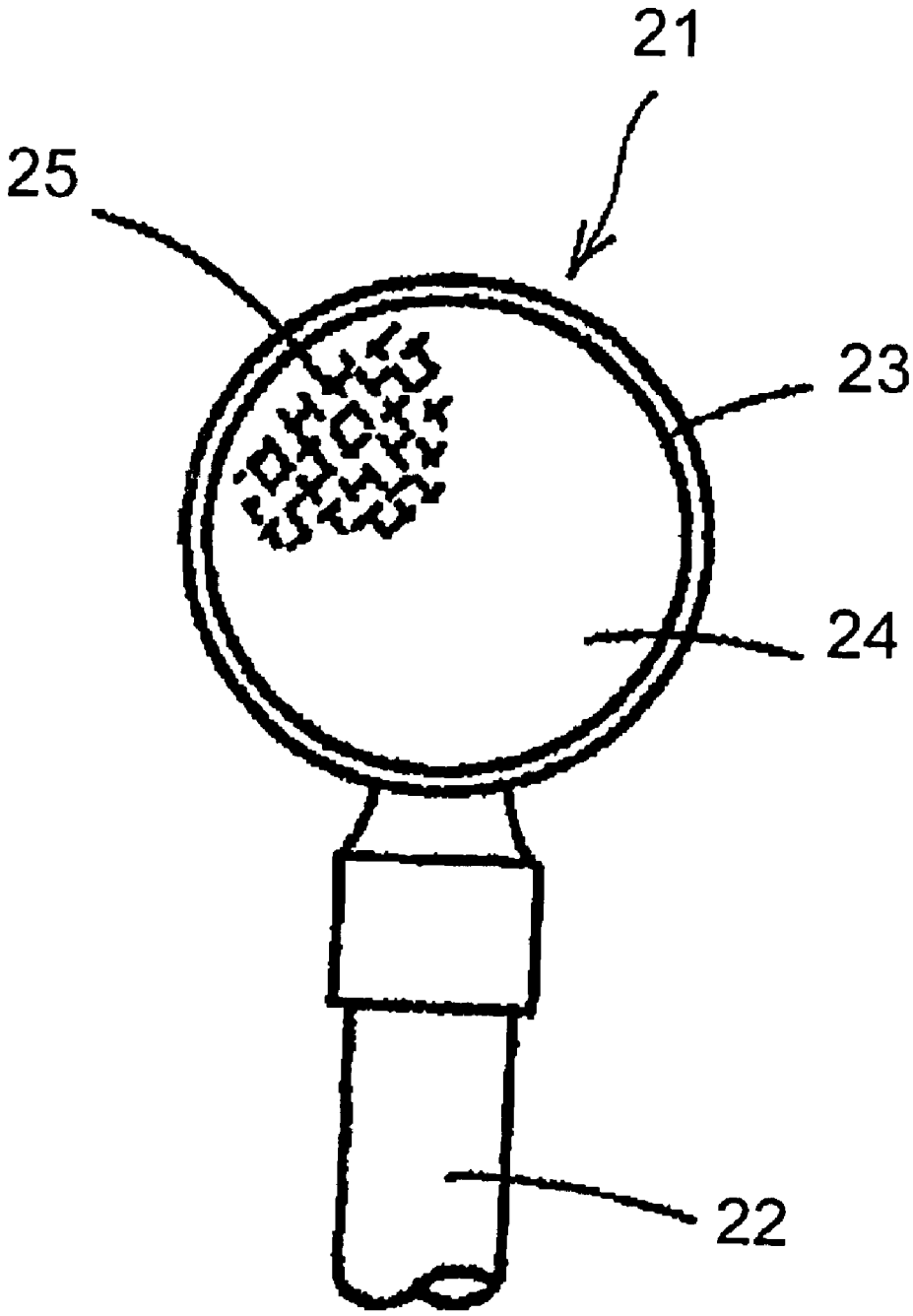
FIG. 10 is a front view showing the critical portion of a visual guide marker device according to a fourth preferred embodiment of the present invention.
Figure 11:
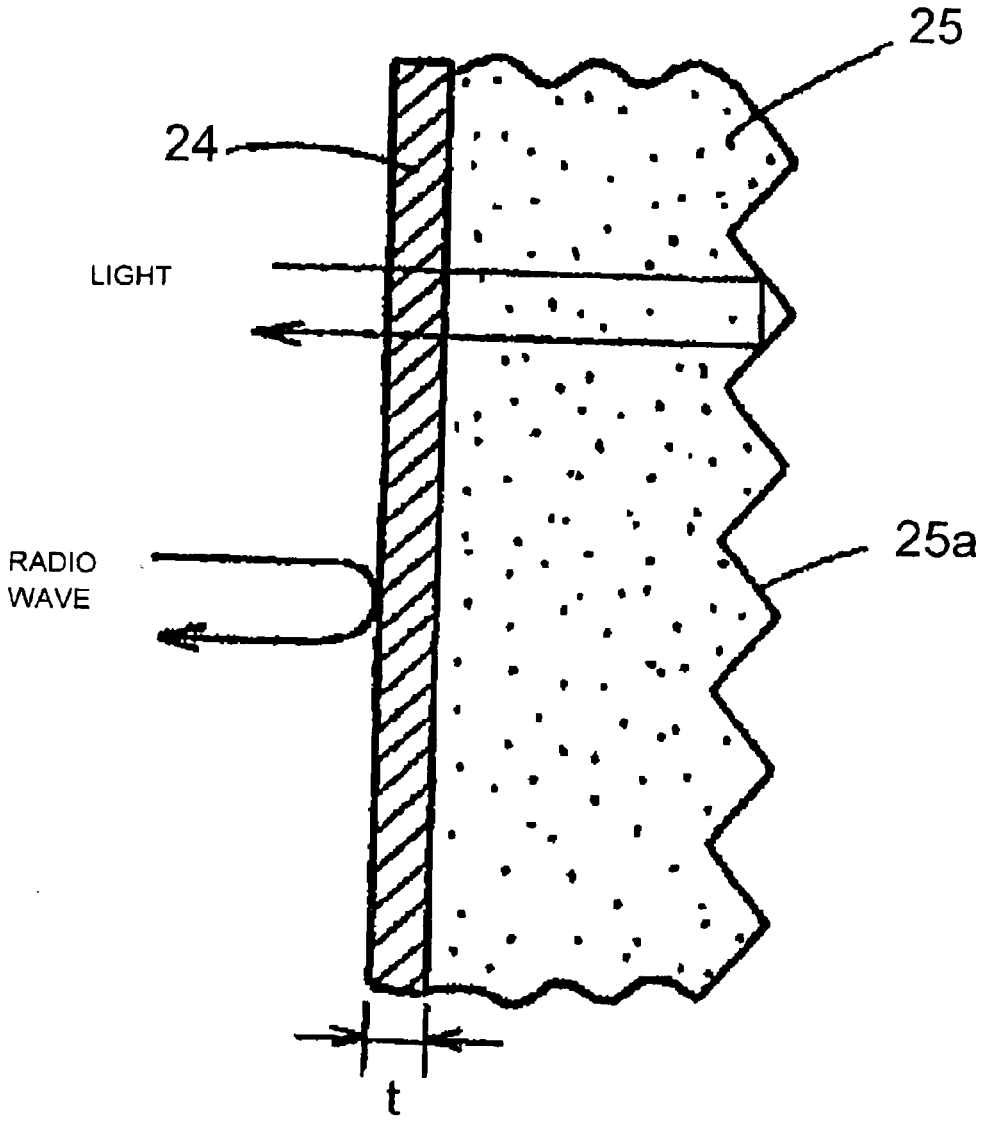
FIG. 11 is an enlarged longitudinal sectional view showing a part of the visual guide marker device according to the fourth preferred embodiment of the present invention.

FIG. 10 is a front view showing the critical portion of a visual guide marker device according to a fourth preferred embodiment and FIG. 11 is an enlarged longitudinal sectional view showing a portion thereof. In FIGS. 10 and 11, parts which are the same as or correspond to those in FIGS. 7 to 9 are denoted by the same reference numerals.

The visual guide marker device 21 according to the fourth preferred embodiment is used as a delineator, and includes the post 22 such as a guard rail, the circular frame 23 which is attached to the top of the post 22, and the disk-shaped guide marker 24 and the light reflector 25 fit in the frame 23 such that they are laminated to one another. In this preferred embodiment, the guide marker 24 is provided on a front stage in the incident direction of radio waves or light and the light reflector 25 is provided on a back stage. Further, both of the guide marker 24 and the light reflector 25 are bonded via an adhesive or other suitable bonding material.

Herein, the light reflector 25 includes a translucent synthetic resin, such as polycarbonate containing fluorescent dye. As shown in FIG. 11, the prism surface 25*a*, having a triangular-pyramid-shape or a square-pyramid-shape, is provided on the surface opposite to the surface contacting the guide marker 24. With this configuration, light entering the light reflector 25 is reflected in substantially the same direction as the incident direction by the prism surface 25*a*.

The guide marker 24 includes a dielectric material having a high permittivity and is formed in a flat-plate shape including a light-transmissive ceramic. The relative permittivity of the guide marker 24 is preferably greater than that of the light reflector 25. Further, the thickness t of the guide marker 24 is preferably defined by the following expression: $t=\lambda\cdot n/(2\cdot\sqrt{\in r})$, where $\lambda$ is the wavelength of incident radio wave, n is an integer, and $\in r$ is relative permittivity.

That is, when the guide marker 24 is flat-plate shaped, the incident radio waves are reflected in almost the same direction as the incident direction. When the relative permittivity of the guide marker 24 is greater than that of the light reflector 25, sufficient radio-wave reflection intensity is effectively ensured. Further, when the thickness t of the guide marker 24 is set to the value described above, the intensity of reflected radio waves is increased, and thus, the radio waves is efficiently reflected even when the thickness of the guide marker 24 is reduced.

When direct sunlight, diffused sunlight, or light from the headlight of a vehicle is radiated to the visual guide marker device 21 of this preferred embodiment, the light passes through the translucent guide marker 24 and enters the light reflector 25. Then, the incident light becomes fluorescent light directly or by the fluorescent dye contained in the translucent synthetic resin, and is reflected in substantially the same direction as the incident direction at the prism surface 25*a* of the light reflector 25. The reflected light passes through the guide marker 24 again and is visually recognized by the driver so that visual guiding is achieved.

On the other hand, when radio waves transmitted from the vehicle-mounted radar are radiated to the visual guide marker device 21, the radio waves are reflected at the guide marker 24 and are then received by the radar. Therefore, when the light which is reflected at the light reflector 25 cannot be visually recognized due to carelessness of the driver or bad weather, the visual guide marker device 21 is detected via the radio waves.

Accordingly, by receiving radio waves which have been reflected at the guide marker 24 by a vehicle-mounted radar, the range of travel of the vehicle is restricted so as to guide the vehicle in a desired direction or the driver is notified that the vehicle is approaching a dangerous place. The visual guide marker device 21 according to the fourth preferred embodiment can be separately manufactured. Alternatively, the guide marker 24 can be provided over the surface of an existing light reflector 25, which has a reflection characteristic, so as to form the visual guide marker device 21. Thus, the visual guide marker device can be miniaturized more easily.

Fifth Preferred Embodiment

Figure 12:
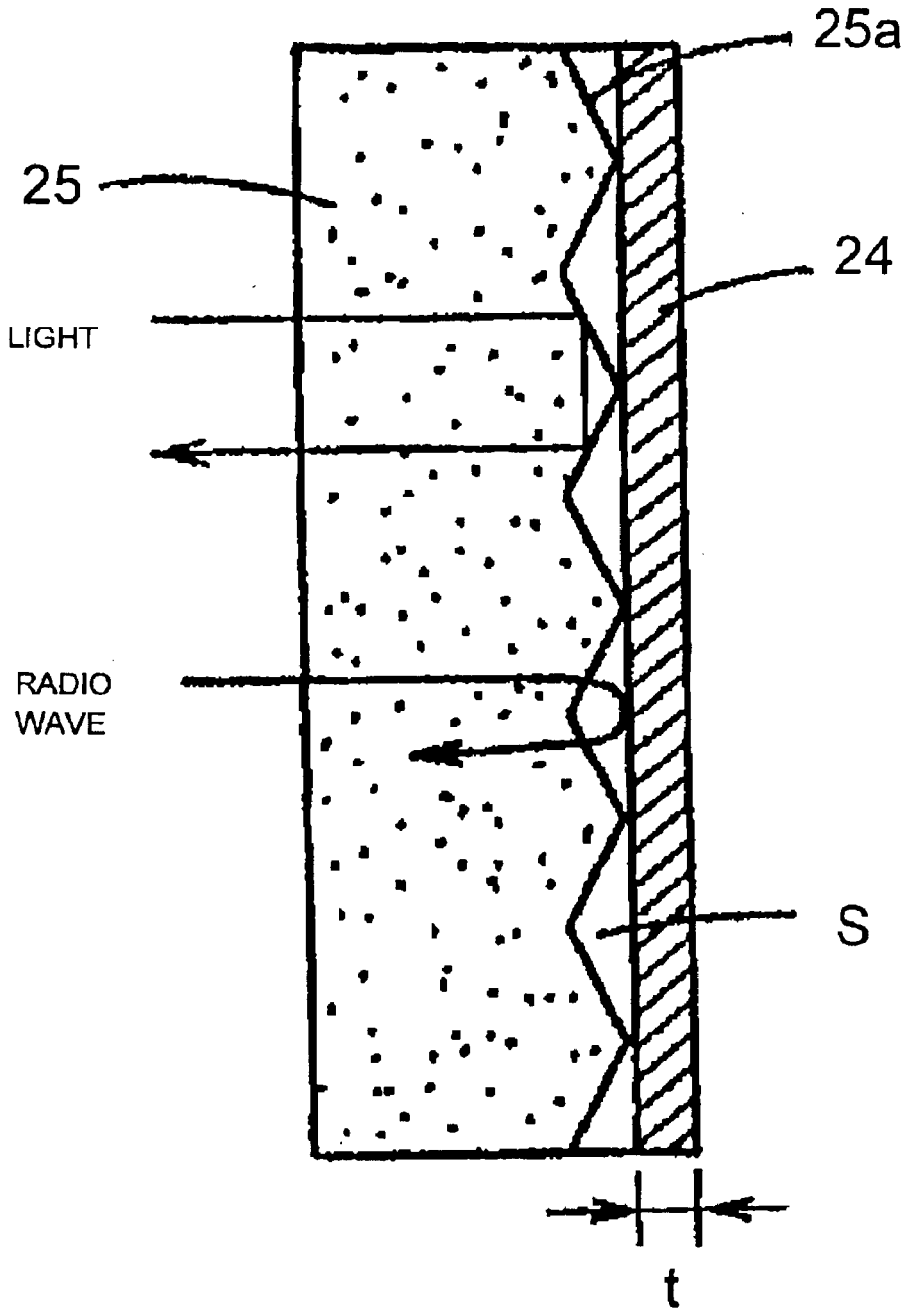
FIG. 12 is an enlarged longitudinal sectional view showing a part of a visual guide marker device according to a fifth preferred embodiment of the present invention.
Figure 13:
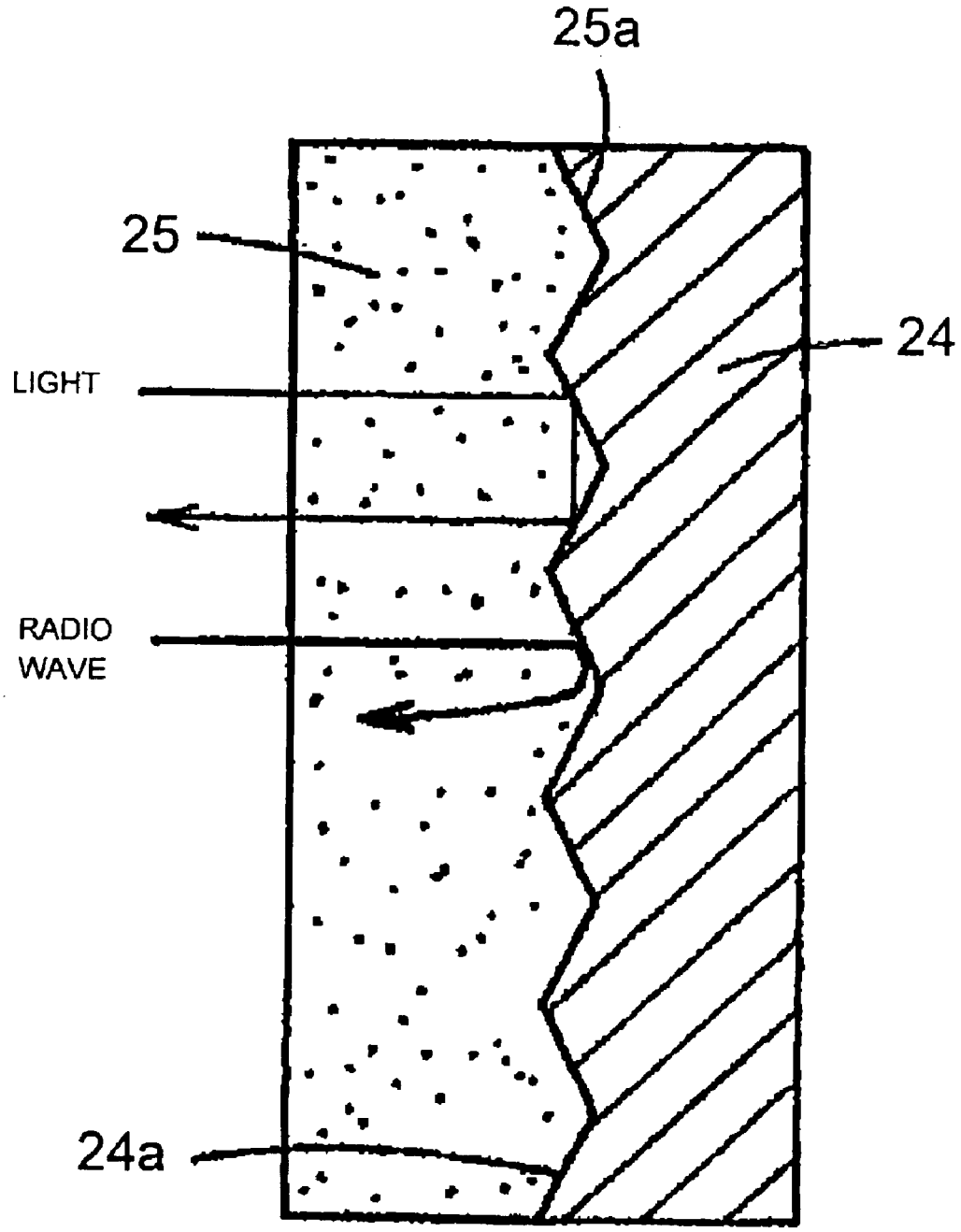
FIG. 13 is a longitudinal sectional view showing a modification of a part of the visual guide marker device according to the fifth preferred embodiment of the present invention.

FIG. 12 is an enlarged longitudinal sectional view showing a portion of a visual guide marker device according to a fifth preferred embodiment, and FIG. 13 is a longitudinal sectional view showing a modification thereof. In FIGS. 12 and 13, parts which are the same as or correspond to those in FIGS. 7 to 11 are denoted by the same reference numerals.

The entire configuration of the visual guide marker device 21 of the fifth preferred embodiment is preferably the same as that of the fourth preferred embodiment shown in FIG. 10. That is, the disk-shaped guide marker 24 and the light reflector 25 are laminated inside the circular frame 23, which is attached at the top of the post 22. Further, in the fifth preferred embodiment, the light reflector 25 is provided on a front stage in the incident direction of radio waves or light and the guide marker 24 is provided on a back stage. Both of the guide marker 24 and the light reflector 25 are bonded to each other via an adhesive or other suitable bonding material.

Further, the light reflector 25 is preferably the same as that in the third and fourth preferred embodiments. The prism surface 25*a*, having a triangular-pyramid-shape or a square-pyramid-shape, is provided on the back surface of the light reflector 25, which is the surface opposite to the surface contacting the guide marker 24. On the other hand, the guide marker 24 preferably includes a ceramic flat plate. Thus, a space S exists between the prism surface 25*a* of the light reflector 25 and the guide marker 24, which is a flat plate.

The relative permittivity $\in r$ and the thickness t of ceramic used for the guide marker 24 are substantially the same as those in the third and fourth preferred embodiments. Also, in the fifth preferred embodiment, the guide marker 24 need not be translucent, and a metallic plate may be used instead of a ceramic plate.

In the visual guide marker device 21 according to the fifth preferred embodiment, light is reflected in substantially the same direction as the incident direction at the prism surface 25*a* of the light reflector 25 as in the fourth preferred embodiment, and thus, visual guiding is performed. Radio waves transmitted from the vehicle-mounted radar pass the light reflector 25, are reflected at the guide marker 24, and are received by the vehicle-mounted radar. Accordingly, even when light which has been reflected at the light reflector 25 cannot be sufficiently recognized visually, the visual guide marker device 21 is reliably detected via radio waves.

Incidentally, in the visual guide marker device 21 according to the fifth preferred embodiment, the flat-plate guide marker 24 is bonded to only the back surface of the light reflector 25, and thus, a space S disadvantageously exists therebetween. In order to overcome such inconvenience, a surface 24*a* of the guide marker 24, which contacts the light reflector 25, is configured so as to match the prism surface 25*a* of the light reflector 25. With this arrangement, a space S is not generated. In this case, the surface 24*a* of the guide marker 24 is prism-shaped, and thus, radio waves are reflected in a wider range.

Further, the light reflector 25 is used in the third to fifth preferred embodiments. Alternatively, a light-generator, that is, a component which generates light may be used instead of the light reflector 25. Also, the visual guide marker device is used as a delineator in the third to fifth preferred embodiments. However, the present invention can be applied to various types of visual guide marker devices as shown in FIGS. 14A to 14C.

Figure 14A:
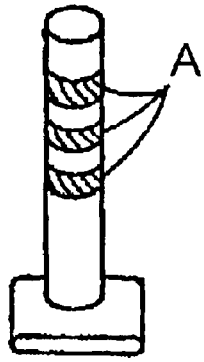
FIGS. 14A to 14C are front views showing other examples of the visual guide marker device according to the third to fifth preferred embodiments of the present invention.
Figure 14B:
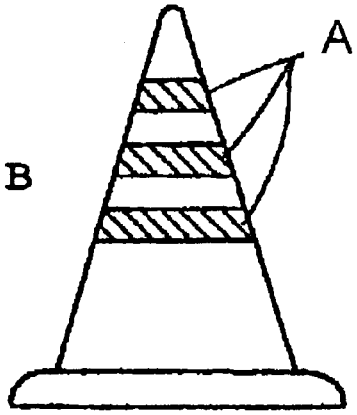
Figure 14C:
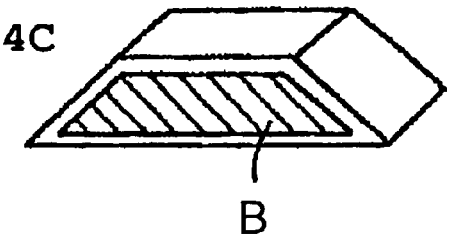

That is, in the examples shown in FIGS. 14A and 14B, the guide marker 24 and the light reflector 25 are attached to desired portions A of a column-shaped or cone-shaped pole cone so that both of light and radio waves are reflected. Also, in the example shown in FIG. 14C, the guide marker 24 and the light reflector 25 are attached to portion B of a trapezoidal road stud so that both of light and radio waves are reflected at the guide marker 24 and the light reflector 25.

Sixth Preferred Embodiment

Figure 15:
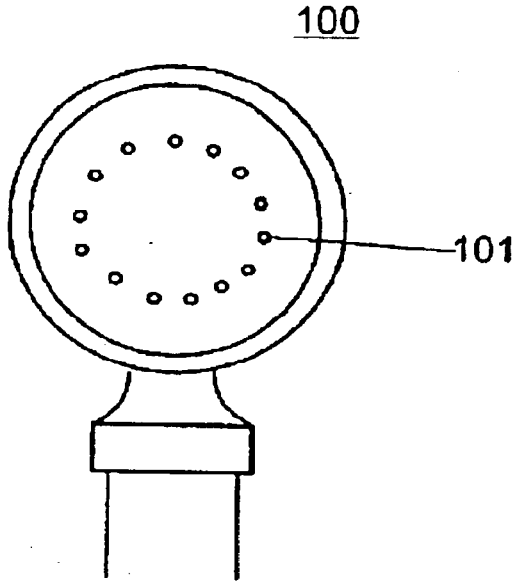
FIG. 15 is a front view showing the critical portion of a visual guide marker device according to a sixth preferred embodiment of the present invention.
Figure 16:
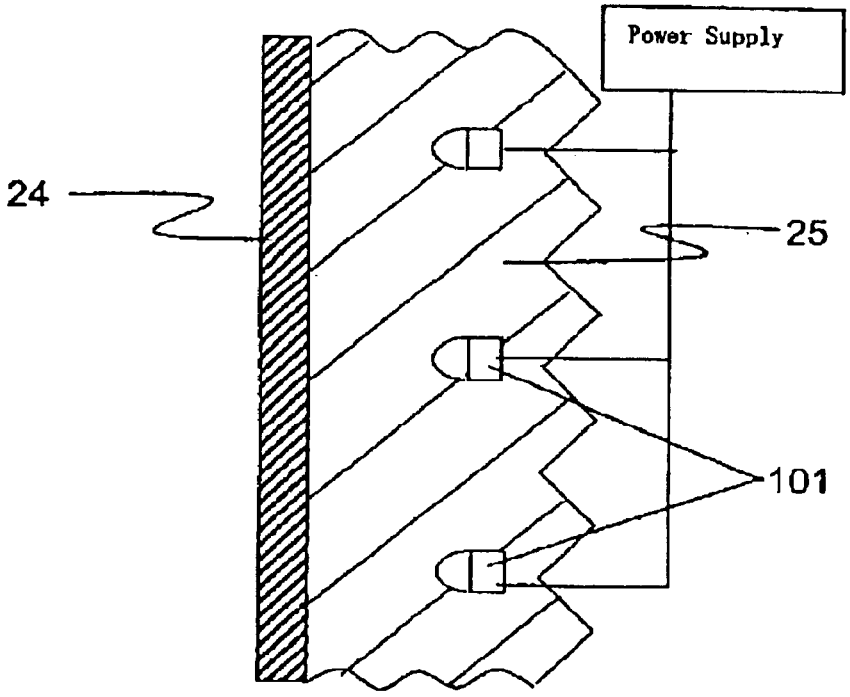
FIG. 16 is an enlarged longitudinal sectional view showing a part of the visual guide marker device according to the sixth preferred embodiment of the present invention.

FIG. 15 is a front view showing a visual guide marker device 100 according to a sixth preferred embodiment, and FIG. 16 is an enlarged longitudinal sectional view showing a portion thereof. In the sixth preferred embodiment, a light reflector 25 includes a light-generating component 101 which self-generates light. The light-generating component 101 may be a light emitting diode (LED).

Figure 17:
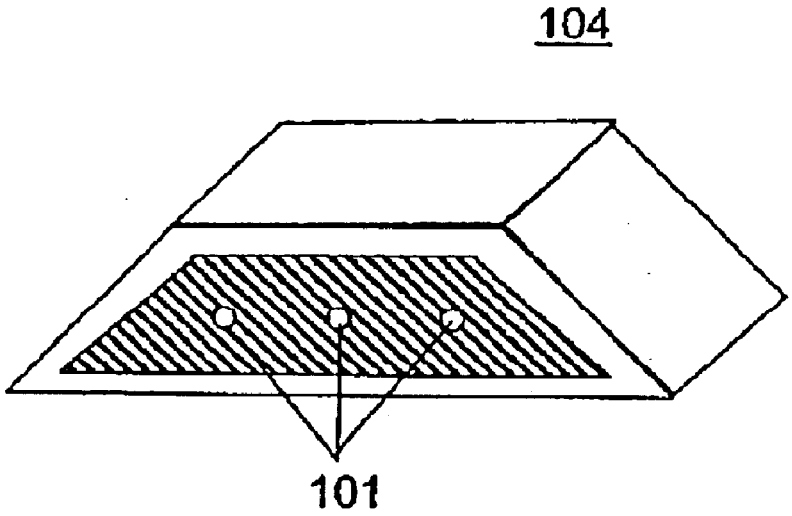
FIG. 17 is a front view showing another example of the visual guide marker device according to the sixth preferred embodiment of the present invention.

FIG. 17 is another example of a visual guide marker device according to the sixth preferred embodiment of the present invention including the light generating components.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A guide marker comprising:

a radio-wave reflecting unit for reflecting radio waves in an incident direction of the radio waves, the radio-wave reflecting device being provided on the surface of a substrate, the radio-wave reflecting unit reflects the radio waves in at least two incident directions; wherein the radio-wave reflecting unit includes a concave portion that extends into the substrate and a convex portion that extends out of the substrate surface.

2. The guide marker according to claim 1, wherein each of the concave and convex portions is substantially hemispherical.

3. The guide marker according to claim 1, wherein each of the concave and convex portions extends substantially linearly.

4. The guide marker according to claim 1, wherein the radio-wave reflecting unit and the substrate include one of metal and ceramic.

5. The guide marker according to claim 1, wherein the radio-wave reflecting unit includes radio-wave reflectors which resonate at a frequency of incident radio waves and which reflect the radio waves in the incident direction, and the radio-wave reflectors are mounted on the substrate.

6. The guide marker according to claim 5, wherein a plurailty of the radio-wave reflectors are arranged in rows, and the pitches of the radio-wave reflectors in each row are different from each other.

7. The guide marker according to claim 5, wherein a plurality of the radio-wave reflectors are arranged in rows, and the pitch d of the radio-wave reflectors in each row is defined by an expression: $d=\lambda \cdot n/2$, where $\lambda$ is the wavelength of the incident radio waves and n is an integer.

8. The guide marker according to claim 5, wherein the radio-wave reflectors are made of one of metal and ceramic grain.

9. The guide marker according to claim 4, wherein a relative permittivity $\in r$ of the ceramic is equal to or greater than about 5.

10. The guide marker according to claim 9, wherein the ceramic is recycled industrial waste generated from electronic components.

11. A visual guide marker device comprising:

one of a light-reflecting component having a reflection characteristic and light-generating component which self-generates light; and a guide marker including a ceramic material.

12. The visual guide marker device according to claim 11, wherein a relative permittivity of the guide marker is greater than that of at least one of the light-reflecting component and the light-generating component.

13. The visual guide marker device according to claim 11, wherein a thickness t of the guide marker is defined by an expression: $t=\lambda \cdot n/(2 \cdot \sqrt{\in r})$, where $\lambda$ is the wavelength of the incident radio waves, n is an integer, and $\in r$ is relative permittivity.

14. The visual guide marker device according to claim 11, wherein the light-reflecting component is provided at a front stage with respect to the incident direction of radio waves and the guide marker is provided at a back stage with respect to the incident direction of radio waves.

15. The visual guide marker device according to claim 11, wherein the guide marker is provided at a front stage with respect to the incident direction of radio waves and the light-reflecting component is provided at a back stage with respect to the incident direction of radio waves.

16. The visual guide marker device according to claim 14, wherein the guide marker includes light-transmissive ceramic.

17. The visual guide marker device according to claim 11, wherein the guide marker reflects radio waves in substantially the same direction as the incident direction of the radio waves.

18. The visual guide marker device according to claim 11, wherein the guide marker includes a radio-wave reflecting device for reflecting radio waves in an incident direction of the radio waves, the radio-wave reflecting device being provided on the surface of a substrate, and the radio-wave reflecting device reflects the radio waves in at least two incident directions.

19. The visual guide marker device according to claim 18, wherein the radio-wave reflecting device includes a concave portion and a convex portion integrally provided in the substrate.

* * * * *